US012577959B2

(12) United States Patent
Yamazaki et al.

(10) Patent No.: US 12,577,959 B2
(45) Date of Patent: Mar. 17, 2026

(54) AXIAL FAN

(71) Applicant: SANYO DENKI CO., LTD., Tokyo (JP)

(72) Inventors: Yoshihisa Yamazaki, Tokyo (JP); Satoshi Tateyama, Tokyo (JP)

(73) Assignee: SANYO DENKI CO., LTD., Tokyo (JP)

( * ) Notice: Subject to any disclaimer, the term of this patent is extended or adjusted under 35 U.S.C. 154(b) by 48 days.

(21) Appl. No.: 18/452,133

(22) Filed: Aug. 18, 2023

(65) Prior Publication Data

US 2024/0060509 A1 Feb. 22, 2024

(30) Foreign Application Priority Data

Aug. 22, 2022 (JP) ..... 2022-132016

(51) Int. Cl.

| | |
|---|---|
| ***F04D 29/52*** | (2006.01) |
| ***F04D 19/00*** | (2006.01) |
| ***F04D 25/06*** | (2006.01) |
| *F04D 29/66* | (2006.01) |

(52) U.S. Cl.

CPC ..... *F04D 29/522* (2013.01); *F04D 19/002* (2013.01); *F04D 25/06* (2013.01); *F04D 25/0613* (2013.01); *F04D 29/665* (2013.01); *F04D 29/667* (2013.01)

(58) Field of Classification Search

CPC .... F04D 19/002; F04D 25/06; F04D 25/0613; F04D 29/522; F04D 29/661; F04D 29/665; F04D 29/667

See application file for complete search history.

(56) References Cited

U.S. PATENT DOCUMENTS 4,596,921 A * 6/1986 Hersh ..... A45D 20/10 392/385
7,416,386 B2 * 8/2008 Ho ..... F04D 29/526 415/222

(Continued)

FOREIGN PATENT DOCUMENTS

| | | |
|---|---|---|
| JP | 2002188599 A | 7/2002 |
| JP | 2002242893 A | 8/2002 |
| JP | 2017137871 A | 8/2017 |

OTHER PUBLICATIONS

Japanese Office Action (JPOA) dated Dec. 5, 2025 issued for Japanese Patent Application No. 2022-132016.

*Primary Examiner* — Charles G Freay
*Assistant Examiner* — Joseph S. Herrmann
(74) *Attorney, Agent, or Firm* — RANKIN, HILL & CLARK LLP

(57) ABSTRACT

An axial fan includes: an impeller cup including a blade extending in a radial direction; a motor configured to rotate the impeller cup; and a housing accommodating the impeller cup and the motor. The housing includes: a casing portion covering an outer periphery of the impeller cup; a base portion supporting the motor; and a spoke portion connecting the base portion and the casing portion. The casing portion includes an inlet surface where air is drawn in, and an outlet surface where air is discharged. The casing portion is provided with a level difference portion at least partially in an inner peripheral surface of the casing portion on the outlet surface side.

13 Claims, 7 Drawing Sheets

(56) References Cited

U.S. PATENT DOCUMENTS

| | | | | |
|---|---|---|---|---|
| 8,870,528 | B2 * | 10/2014 | Teramoto | F04D 25/062 415/220 |
| 2002/0076323 | A1 * | 6/2002 | Fujinaka | F04D 29/547 415/222 |
| 2007/0122278 | A1 * | 5/2007 | Ho | F04D 25/0613 415/220 |
| 2007/0292261 | A1 * | 12/2007 | Tang | F04D 29/663 415/119 |
| 2016/0017895 | A1 * | 1/2016 | Chang | F04D 29/663 415/119 |
| 2020/0332810 | A1 * | 10/2020 | Liu | F04D 19/007 |

* cited by examiner

AXIAL FAN

CROSS-REFERENCE TO RELATED APPLICATION

This application is based on Japanese Patent Application No. 2022-132016 filed with the Japan Patent Office on Aug. 22, 2022, the entire content of which is hereby incorporated by reference.

BACKGROUND

1. Technical Field

One aspect of the present disclosure relates to an axial fan.

2. Related Art

A frame of an axial fan is conventionally thinned from the perspective of a material reduction and from the perspective of product quality at the time of molding. For example, an axial fan disclosed in JP-A-2017-137871 is provided with a lightening portion on an inlet surface side of the frame.

However, providing the frame with the lightening portion may affect the flow of air in the axial fan. Hence, the position where in the frame the lightening portion is provided is important. However, JP-A-2017-137871 does not disclose the relationship between the position where the lightening portion is provided and the flow of air in the axial fan. Therefore, there is room for improvement in the relationship between the position where in the frame the lightening position is provided and the air flow efficiency of the fan.

Hence, an object of the present disclosure is to provide an axial fan whose air flow efficiency can be increased.

SUMMARY

An axial fan includes: an impeller cup including a blade extending in a radial direction; a motor configured to rotate the impeller cup; and a housing accommodating the impeller cup and the motor. The housing includes: a casing portion covering an outer periphery of the impeller cup; a base portion supporting the motor; and a spoke portion connecting the base portion and the casing portion. The casing portion includes an inlet surface where air is drawn in, and an outlet surface where air is discharged. The casing portion is provided with a level difference portion at least partially in an inner peripheral surface of the casing portion on the outlet surface side.

DETAILED DESCRIPTION

Figure 1:
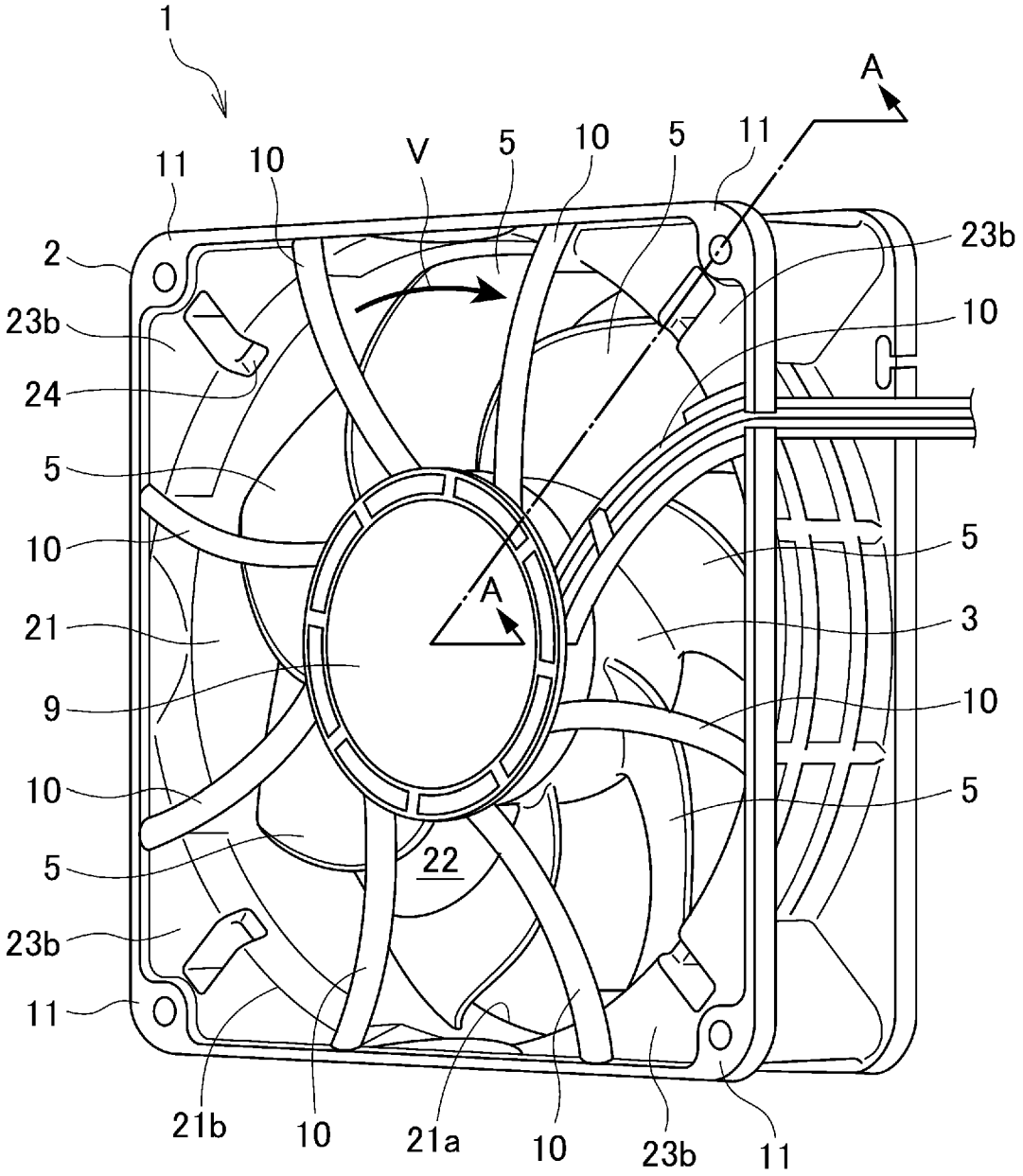
FIG. 1 is a perspective view of an axial fan according to an embodiment of the present disclosure as viewed from an air outlet side.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

An axial fan of one aspect of the present disclosure includes: an impeller cup including a blade extending in a radial direction; a motor configured to rotate the impeller cup; and a housing accommodating the impeller cup and the motor. The housing includes: a casing portion covering an outer periphery of the impeller cup; a base portion supporting the motor; and a spoke portion connecting the base portion and the casing portion. The casing portion includes an inlet surface where air is drawn in, and an outlet surface where air is discharged. The casing portion is provided with a level difference portion at least partially in an inner peripheral surface of the casing portion on the outlet surface side.

An axial fan of another aspect of the present disclosure includes: an impeller cup including a blade extending in a radial direction; a motor configured to rotate the impeller cup; and a housing accommodating the impeller cup and the motor. The housing includes: a casing portion covering an outer periphery of the impeller cup; a base portion supporting the motor; and a spoke portion connecting the base portion and the casing portion. The casing portion includes an inlet surface where air is drawn in, and an outlet surface where air is discharged. A lightening portion is open in the outlet surface of the casing portion, at a position off an extension line of the spoke portion in a longitudinal direction of the spoke portion.

According to the one aspect and the another aspect of the present disclosure, it is possible to provide an axial fan whose air flow efficiency can be increased.

An embodiment of the present disclosure is described hereinafter with reference to the drawings. Note that descriptions of members having the same reference numerals as members that have already been described are omitted in the detailed description for the convenience of description. Moreover, the dimensions of each member illustrated in the drawings may be different from actual dimensions thereof for the convenience of description.

Figure 2:
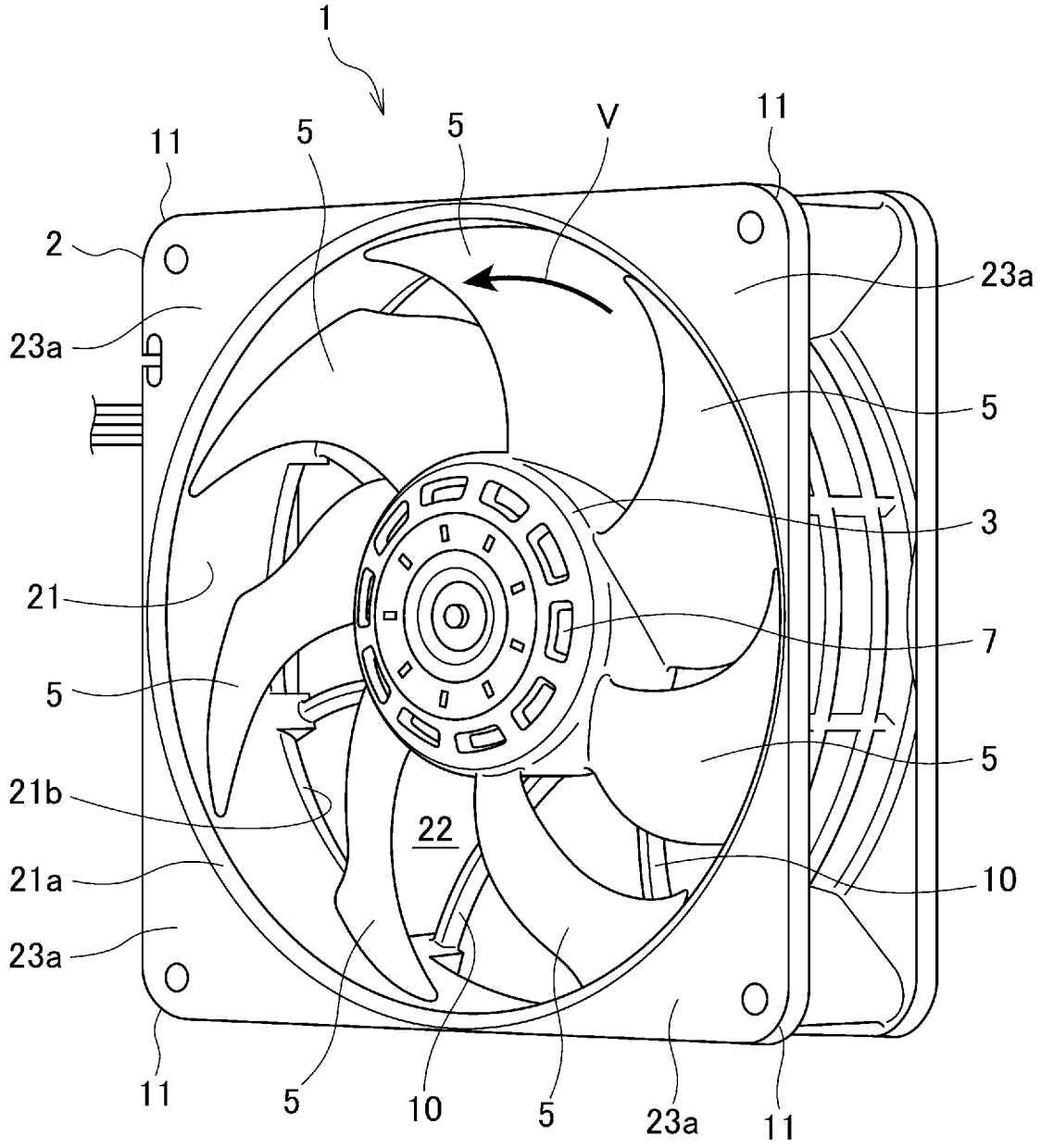
FIG. 2 is a perspective view of the axial fan illustrated in FIG. 1 as viewed from an air inlet side.

FIG. 1 is a perspective view of an axial fan according to the embodiment of the present disclosure as viewed from an air outlet side. FIG. 2 is a perspective view of the axial fan illustrated in FIG. 1 as viewed from an air inlet side. As illustrated in FIGS. 1 and 2, an axial fan 1 according to the embodiment includes a housing 2, an impeller cup 3 placed in the housing 2, and a motor 7 that rotates the impeller cup 3. The impeller cup 3 includes a plurality of (seven in this example) blades 5 that extend in the radial direction. The motor 7 is accommodated in a cup of the impeller cup 3.

The housing 2 accommodates the impeller cup 3 and the motor 7. The entire housing 2 is formed in a polygonal shape (a rectangular shape in this example). The housing 2 includes a cylindrical casing portion 21 that covers the outer periphery of the impeller cup 3, a base portion 9 that supports the motor 7 accommodated in the impeller cup 3, spoke portions 10 that connect the base portion 9 and the casing portion 21, and corner portions 11 that form a rectangle. The housing 2 is mainly made of resin.

The casing portion 21 includes an inlet 21*a* through which air is drawn in (an opening in the casing portion on the front side in FIG. 2), and an outlet 21*b* through which the air that has been drawn in is discharged (an opening in the casing portion on the front side in FIG. 1). The casing portion 21 forms an airway 22 that communicates with the inlet 21*a* and the outlet 21*b*. With the rotation of the blades 5, the air drawn in through the inlet 21*a* is sent in a direction along the airway 22 (hereinafter referred to as an air-blowing direction W), and discharged to the outside through the outlet 21*b*. Moreover, the casing portion 21 includes an inlet surface 23*a* provided to the outer peripheral portion of the inlet 21*a*, and an outlet surface 23*b* provided to the outer peripheral portion of the outlet 21*b*. FIG. 1 is a perspective view of the axial fan 1 as viewed from the outlet 21*b* side of the casing portion 21. FIG. 2 is a perspective view of the axial fan 1 as viewed from the inlet 21*a* side of the casing portion 21. Note that a direction of an arrow V illustrated in the drawings indicates the rotation direction of the blades 5.

Figure 3:
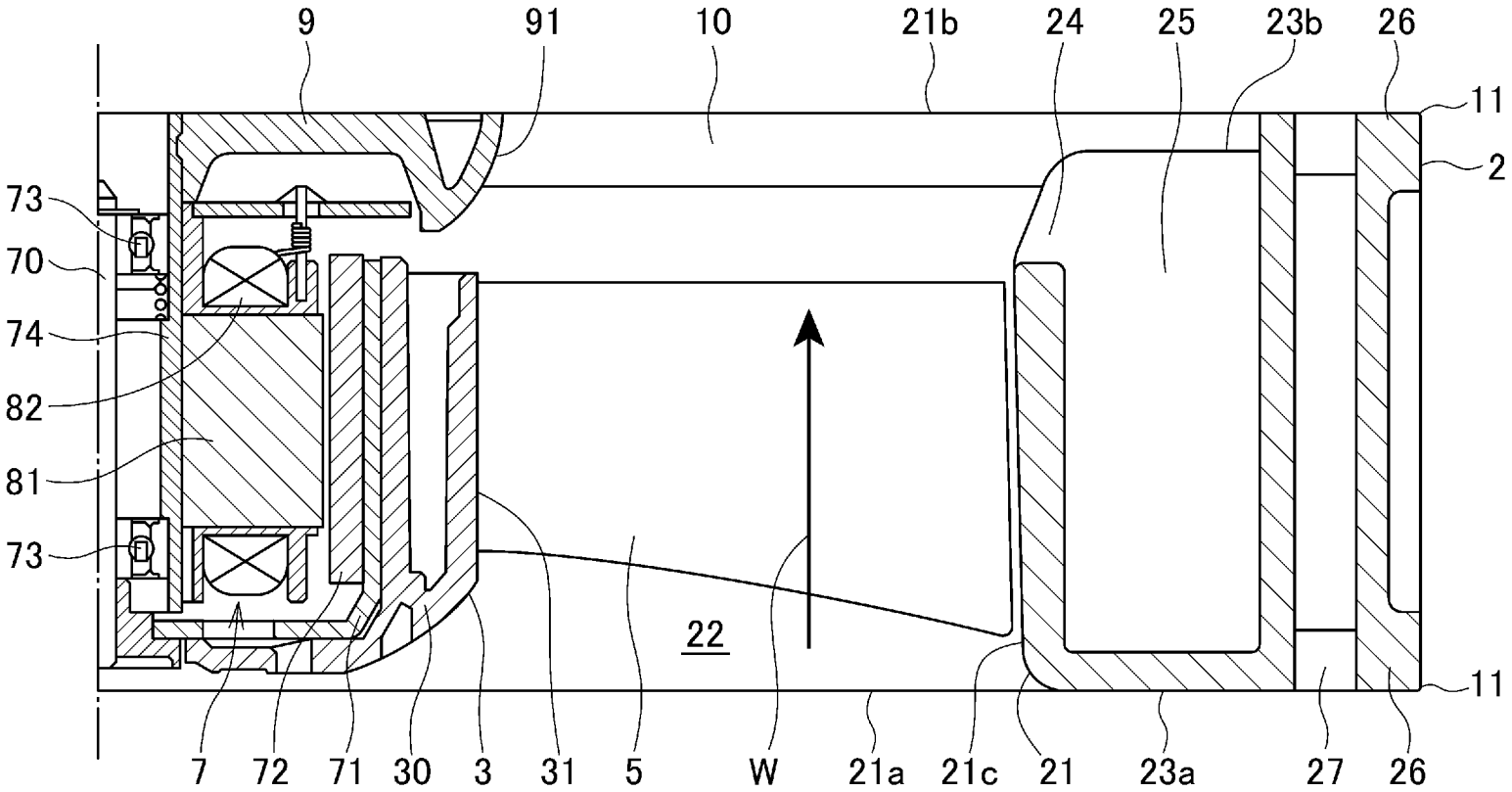
FIG. 3 is a cross-sectional view of the axial fan illustrated in FIG. 1, taken along line A-A.

FIG. 3 is a cross-sectional view of the axial fan 1 illustrated in FIG. 1, taken along line A-A. As illustrated in FIG. 3, a central portion of a cup 30 of the impeller cup 3 is fixed to a rotary shaft 70 of the motor 7. In the following description, a direction along the rotary shaft 70 is referred to as the "axial direction," and a direction of the radius centered around the rotary shaft 70 is referred to as the "radial direction," or "radially".

The rotary shaft 70 is provided in a central portion of the airway 22 in such a manner as to be along the airway 22 (the air-blowing direction W). The impeller cup 3 is fixed to the rotary shaft 70 in such a manner as to orient the opening side of the cup 30 in a direction toward the outlet 21*b* of the airway 22 and be along the airway 22. An outer peripheral side surface 31 of the cup 30, the outer peripheral side surface 31 being on the outer side in the radial direction, forms an inner peripheral surface of the airway 22 on the inlet 21*a* side. The outer peripheral side surface 31 of the cup 30 is formed in such a manner as to extend parallel to the air-blowing direction W. The impeller cup 30 having the blades 5 rotates, together with the rotary shaft 70, in the airway 22. Consequently, the air is sent in the air-blowing direction W.

The plurality of blades 5 is provided in such a manner as to extend in the radial direction from the outer peripheral side surface 31 of the cup 30. The blades 5 are provided integrally with the cup 30. Each of the plurality of blades 5 is provided in such a manner as to be inclined relative to a direction of the rotary shaft 70.

The motor 7 is accommodated in the cup 30 of the impeller cup 3, as a device that rotationally drives the blades 5. The motor 7 includes an approximately cup-shaped rotor yoke 71, the rotary shaft 70 press-fitted in a central portion of the rotor yoke 71, and a stator core 81 around which a coil 82 is wound.

The rotor yoke 71 is fitted in the cup 30 of the impeller cup 3, and rotates together with the rotary shaft 70. A magnet 72 is attached to an inner surface of the rotor yoke 71. The rotary shaft 70 is rotatably supported by a bearing 73. The bearing 73 is fixed to an inner surface of a tubular support portion 74. The stator core 81 is fixed to an outer surface of the support portion 74. An outer surface of the stator core 81 faces an inner surface of the magnet 72 of the rotor yoke 71 with a gap therebetween.

Moreover, the stator core 81 of the motor 7 is attached to the base portion 9. The base portion 9 is formed in an approximately cup shape. The base portion 9 is provided on the outlet 21*b* side of the airway 22 in such a manner that the opening side of the base portion 9 faces the opening side of the cup 30 of the impeller cup 3. A central portion of the base portion 9 is attached to the stator core 81 of the motor 7, and is fixed to the outer surface of the support portion 74. An outer peripheral side surface 91 of the base portion 9, the outer peripheral side surface 91 being on the outer side in the radial direction, forms the inner peripheral surface of the airway 22 on the outlet 21*b* side. The base portion 9 is provided in the central portion of the airway 22 coaxially with the airway 22.

The spoke portions 10 that couple the base portion 9 and the casing portion 21 are provided on the outlet 21*b* side of the housing 2. A plurality of the spoke portions 10 is provided to the base portion 9 at substantially regular intervals in a circumferential direction of the base portion 9. The base portion 9 and the motor 7 attached to the base portion 9 are supported by the plurality of the spoke portions 10 on the casing portion 21.

The casing portion 21 includes level difference portions 24 in an inner peripheral surface 21*c* on the outlet surface 23*b* side. The level difference portions 24 are provided partially in the inner peripheral surface 21*c* in the circumferential direction. Moreover, the casing portion 21 includes lightening portions 25 in the outlet surface 23*b*. The lightening portions 25 are formed parallel to the air-blowing direction W from the outlet surface 23*b* toward the inlet surface 23*a*. The level difference portions 24 and the lightening portions 25 are further described below by use of FIG. 4.

An edge of each of the corner portions 11 of the housing 2 is provided with flange portions 26 for fixing the housing 2 to, for example, an electronic apparatus. The flange portions 26 are provided, extending radially outward in the housing 2 from the inlet surface 23*a* and the outlet surface 23*b* of the casing portion 21. A fixing hole 27 is formed in the flange portions 26 in such a manner as to penetrate the housing 2. The axial fan 1 can be attached to, for example, an electronic apparatus by, for example, inserting a screw into the fixing hole 27.

Figure 4:
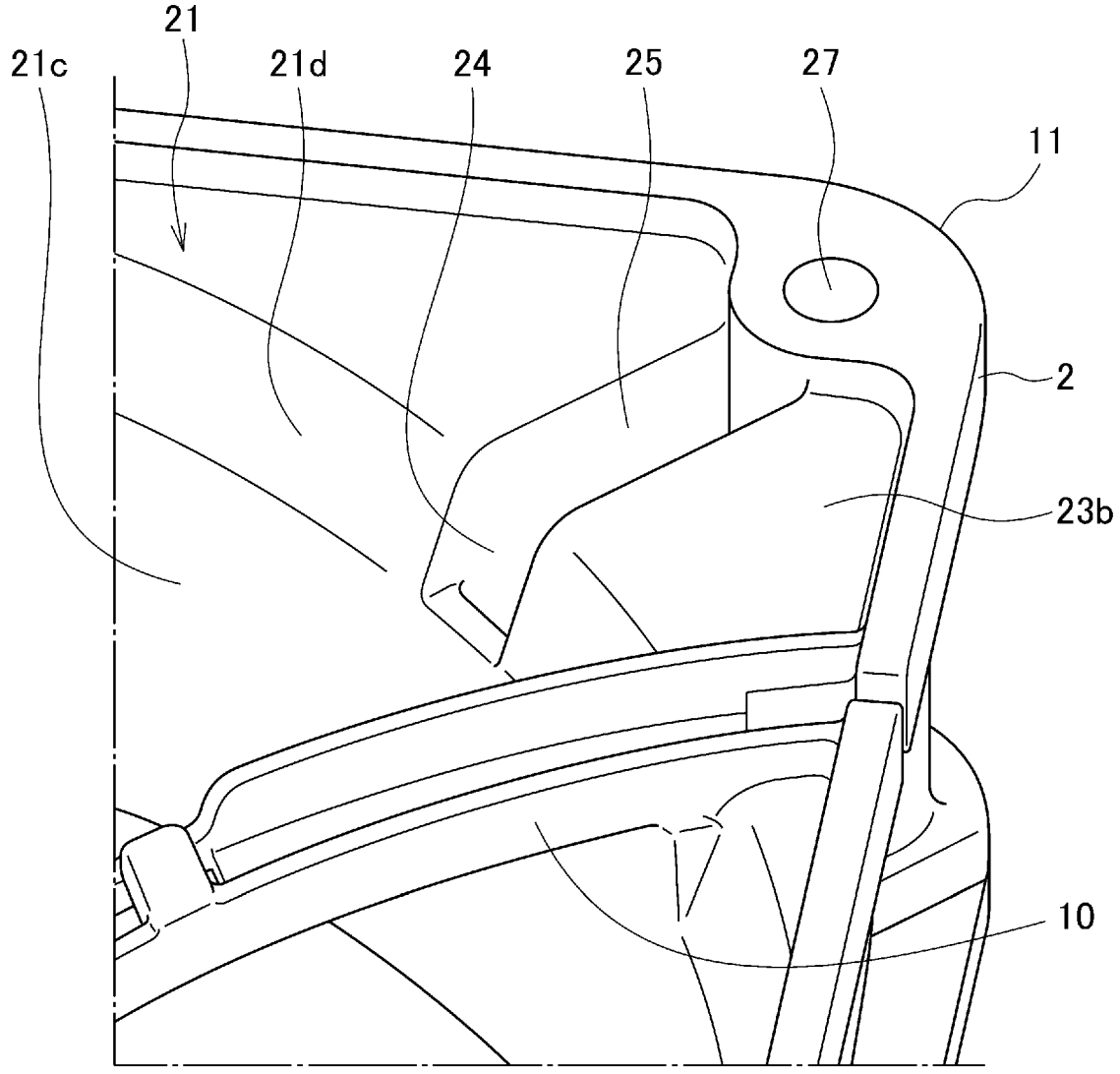
FIG. 4 is a partial enlarged view illustrating a level difference portion and a lightening portion of a casing portion.

FIG. 4 is a partial enlarged view illustrating the level difference portion 24 and the lightening portion 25 of the casing portion 21. As illustrated in FIG. 4, the level difference portion 24 is formed in the inner peripheral surface 21*c* in such a manner as to have a shape recessed from the outlet surface 23*b* toward the inlet surface 23*a* along the airway 22. The level difference portion 24 of this example is formed as a rectangular recess. Note that there is, for example, a case where an end on the outlet surface 23*b* side of the inner peripheral surface 21*c* of the casing portion 21 is provided with a tapered portion 21*d* that increases in diameter toward the outlet surface 23*b* as illustrated in FIG. 4. In this case, the level difference portion 24 is preferably a level difference having the same length (depth) as the length of the tapered portion 21*d* along the airway 22.

The lightening portions 25 are formed partially in the outlet surface 23*b*. The outlet surface 23*b* is provided on the outer peripheral portion of the outlet 21*b*. For example, the area of a region provided to the corner portion 11 of the housing 2 on the outlet surface 23*b* is greater than the area of a region provided to a side of the housing 2 on the outlet surface 23*b*. The lightening portion 25 is formed in the region provided to the corner portion 11 of the housing 2 on the outlet surface 23*b* in such a manner as to extend toward the central portion (the rotary shaft 70) of the airway 22. The lightening portion 25 is open in the form of, for example, a rectangle in plan view perpendicular to the outlet surface 23*b*.

The level difference portion 24 and the lightening portion 25 are provided near the corner portion 11. Moreover, the level difference portion 24 and the lightening portion 25 are provided in the outlet surface 23*b* of the casing portion 21, at a position off an extension line of the spoke portion 10 in a longitudinal direction thereof. In other words, a position on the casing portion 21 where a radially outer end of the spoke portion 10 is connected is set in such a manner as to be different from the position on the casing portion 21 where the level difference portion 24 and the lightening portion 25 are formed. Each of the spoke portions 10 is connected to the outlet surface 23*b* of the casing portion 21, at a position away in the circumferential direction from the position where the level difference portion 24 and the lightening portion 25 are formed.

The level difference portion 24 is provided between the lightening portion 25 and the airway 22 being the internal opening of the casing portion 21. The lightening portion 25 is coupled to the airway 22 of the casing portion 21 via the level difference portion 24. In other words, a radially inner end of the lightening portion 25 that is formed toward the central portion of the airway 22 is connected to the level difference portion 24 formed in the inner peripheral surface 21*c* of the casing portion 21, and is coupled to the airway 22 of the casing portion 21. Note that the level difference portion 24 and the lightening portion 25 are provided in the outlet surface 23*b* of each of the corner portions 11.

Figure 5:
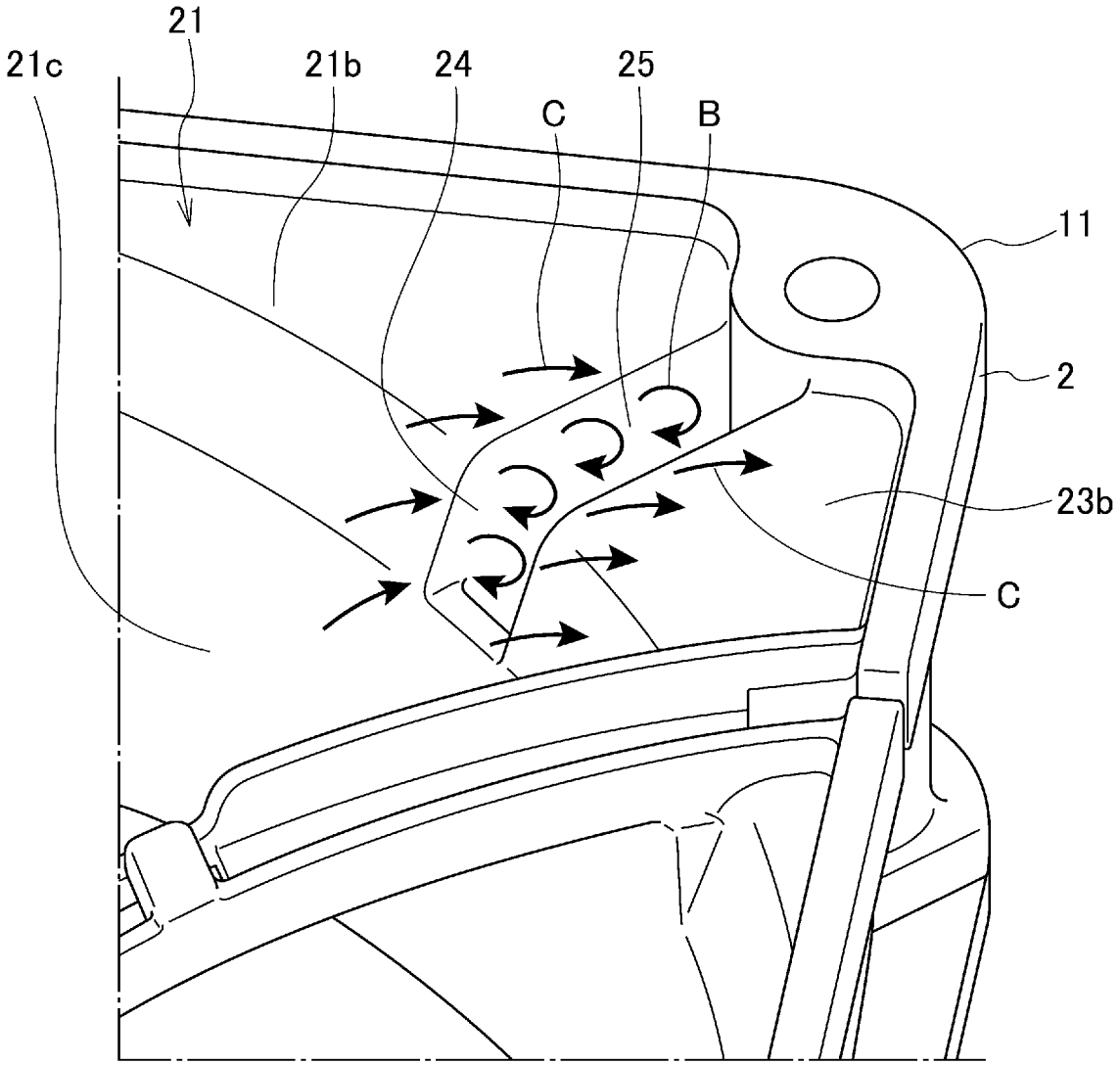
FIG. 5 is a perspective view schematically illustrating the flow of air on the outlet side of the axial fan illustrated in FIG. 1.
Figure 6:
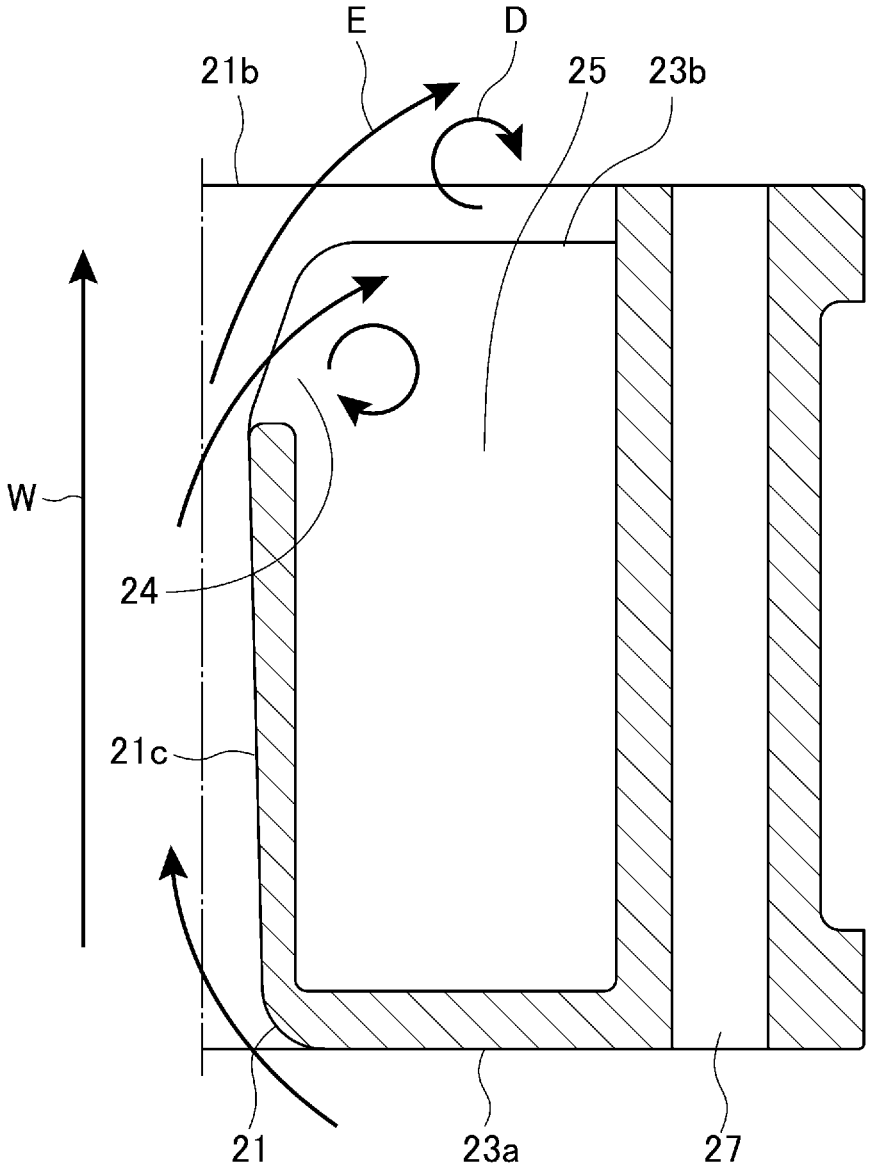
FIG. 6 is a cross-sectional view schematically illustrating the flow of air on the outlet side of the axial fan illustrated in FIG. 1.

FIG. 5 is a perspective view schematically illustrating the flow of air on the outlet 21*b* side of the axial fan 1. FIG. 6 is a cross-sectional view schematically illustrating the flow of air on the outlet 21*b* side of the axial fan 1. As illustrated in FIG. 5, the casing portion 21 is provided with the level difference portion 24 and the lightening portion 25 to allow air to flow like a vortex indicated by, for example, an arrow B at the level difference portion 24 and the lightening portion 25. As a result, it is possible to reduce resistance to air flowing outside the level difference portion 24 and the lightening portion 25, for example, resistance to the flow of air indicated by, for example, an arrow C. Hence, the flow of air can be made smooth on the outlet 21*b* side.

Moreover, as illustrated in FIG. 6, the casing portion 21 is provided with the level difference portion 24 and the lightening portion 25 to allow air to flow unevenly as indicated by, for example, an arrow D at the level difference portion 24 and the lightening portion 25. As a result, air flowing near the inner peripheral surface 21*c* of the casing portion 21 can be guided to the level difference portion 24 as indicated by, for example, an arrow E. Therefore, the flow of air to the outside of the housing can be made smooth on the outlet 21*b* side.

As described above, in the axil fan 1 according to the embodiment of the present disclosure, the level difference portions 24 are provided at least partially in the inner peripheral surface 21*c* of the casing portion 21 on the outlet surface 23*b* side. According to this configuration, the vortices of air are formed by the level difference portions 24. Hence, it is possible to reduce resistance to the air flowing near the inner peripheral surface 21*c* of the casing portion 21. As a result, it is possible to increase the air flow efficiency of the axial fan 1.

Moreover, in the axial fan 1, the lightening portion 25 is provided in the outlet surface 23*b* of the casing portion 21, at the position off the extension line of each of the spoke portions 10 in the longitudinal direction thereof. According to this configuration, the spaces into which the air flowing near the inner peripheral surface 21*c* of the casing portion 21 flows are formed by the lightening portions 25. As a result, it is possible to reduce the resistance to the air flowing near the inner peripheral surface 21*c*. As a result, it is possible to increase the air flow efficiency of the axial fan 1. Moreover, the lightening portion 25 is provided at the position off the extension line of the each of the spoke portions 10 in the longitudinal direction thereof, which enables easy thinning of the housing 2 at the time of manufacture.

Moreover, in the axial fan 1, the level difference portion 24 is provided between the respective lightening portion 25 and the airway 22 of the casing portion 21 and couples the lightening portion 25 and the airway 22. In this manner, providing the level difference portion 24 between the respective lightening portion 25 and the airway 22 facilitates the air flowing near the inner peripheral surface 21*c* of the casing portion 21 flowing into the respective lightening portion 25. As a result, it is possible to reduce the resistance to the air flowing near the inner peripheral surface 21*c*. Hence, it is possible to increase the air flow efficiency of the axial fan 1. Moreover, the thickness between the lightening portion 25 and the airway 22 of the casing portion 21 can be reduced. Therefore, it makes it still easier for air to flow into the lightening portions 25.

Moreover, in the axial fan 1, the housing 2 is formed in a polygonal shape having a plurality of the corner portions 11 in plan view along the air-blowing direction W, and the level difference portion 24 and the lightening portion 25 are provided near each of the plurality of the corner portions 11. In this manner, providing the level difference portion 24 and the lightening portion 25 near the each of the corner portions 11 enables using dead space (the outlet surface 23*b*) that is present in the corner portion 11. Hence, it is possible to avoid an increase in the size of the axial fan 1.

Figure 7:
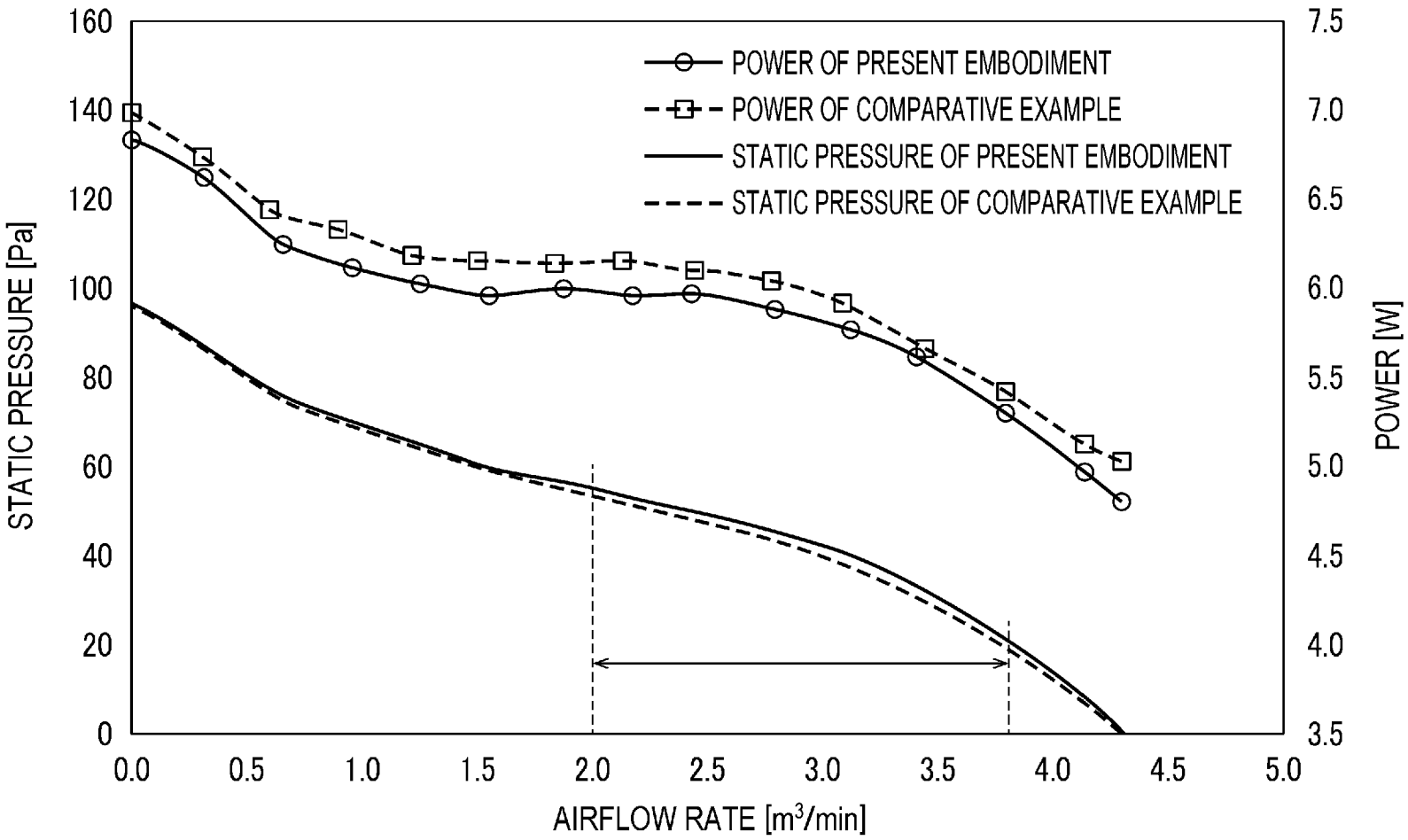
FIG. 7 is a graph illustrating the relationship between airflow rate and static pressure characteristics and the relationship between airflow rate and power consumption in the axial fan according to the embodiment of the present disclosure and an axial fan of a comparative example.

Next, results of a test carried out to check an increase in the air flow efficiency of the axial fan 1 according to the embodiment of the present disclosure are described. FIG. 7 is a graph illustrating the relationship between airflow rate and static pressure characteristics and the relationship between airflow rate and power consumption in the axial fan 1 of the embodiment and an axial fan of a comparative example. Note that the axial fan of the comparative example is configured, omitting the level difference portions 24 and the lightening portions 25 from the configuration of the axial fan 1 of the embodiment.

As illustrated in FIG. 7, it can be seen that in terms of a comparison based on the airflow-static pressure characteristics, the performance of the axial fan 1 of the embodiment in the operating region of the axial fan, for example, the performance of the axial fan 1 of the embodiment at airflow rates of 2.0 to 3.8 [$m^3$/min], is higher than the performance of the axial fan of the comparative example. Moreover, it can be seen that in terms of a comparison based on the airflow rate-power consumption, the power consumption of the axial fan 1 of the embodiment is lower by approximately five percent than the power consumption of the axial fan of the comparative example. Note that the rotational speed of the axial fans was set at 3050 rpm in the test.

Up to this point the embodiment of the present disclosure has been described. In terms of this, it is, however, needless to say that the technical scope of the present disclosure should not be construed in a limited manner by the detailed description. The embodiment is a mere example. Those skilled in the art understand that the embodiment can be modified in various manners within the technical scope of the present disclosure described in the claims. The technical scope of the present disclosure should be determined on the basis of the scope described in the claims and the scope of equivalents thereof.

The case where a single level difference portion 24 and a single lightening portion 25 are provided to the corner portion 11 of the housing 2 is described in the above-mentioned embodiment. However, this configuration is not essential. For example, a plurality of the level difference portions 24 and a plurality of the lightening portions 25 may be provided to the corner portion 11 of the housing 2.

Moreover, in the example described in the above-mentioned embodiment, the level difference portion 24 is a rectangular recess formed in the inner peripheral surface 21*c* along the airway 22. However, this configuration is not essential. The shape of the level difference portion 24 may be, for example, semi-circular or elliptic.

Furthermore, in the example described in the above-mentioned embodiment, the lightening portion 25 is formed in a rectangular shape in plan view perpendicular to the outlet surface 23*b*. However, this configuration is not essential. The shape of the lightening portion 25 may be, for example, circular or elliptic.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. An axial fan comprising:

an impeller cup including a blade extending in a radial direction;

a motor configured to rotate the impeller cup; and a housing accommodating the impeller cup and the motor, wherein the housing includes:

a casing portion covering an outer periphery of the impeller cup;

a base portion supporting the motor; and a spoke portion connecting the base portion and the casing portion, the casing portion includes an inlet surface where air is drawn in, an outlet surface where the air is discharged, and an airway which is an internal opening of the casing portion, the casing portion is provided with a level difference portion only partially in an inner peripheral surface of the casing portion on a side of the outlet surface, the level difference portion is a recess having a shape recessed from the outlet surface toward the inlet surface along the airway, the casing portion is provided with a lightening portion at least partially in the outlet surface, the lightening portion having a rectangular shape in a plan view perpendicular to the outlet surface, the level difference portion is provided between the lightening portion and the airway, the lightening portion is communicated with the airway via the level difference portion, and the lightening portion has a first width in the radial direction and a second width in a circumferential direction of the axial fan, the second width is smaller than the first width.

2. The axial fan according to claim 1, wherein the level difference portion has a third width in the circumferential direction, the third width being identical to the second width of the lightening portion.

3. The axial fan according to claim 1, wherein the level difference portion is formed in the inner peripheral surface of the casing portion so as to have the shape recessed from the outlet surface toward the inlet surface along the airway, an end on the side of the outlet surface of the inner peripheral surface of the casing portion is provided with a tapered portion that increases in diameter toward the outlet surface, and the level difference portion is a level difference having a length same as a length of the tapered portion along the airway.

4. The axial fan according to claim 1, wherein the level difference portion is provided between the lightening portion and the internal opening of the casing portion, and the lightening portion and the internal opening are coupled to each other.

5. The axial fan according to claim 1, wherein a position on the outlet surface of the casing portion where a radially outer end of the spoke portion is connected is set in such a manner as to be different from a position on the casing portion where the level difference portion and the lightening portion are formed.

6. The axial fan according to claim 5, wherein the level difference portion is provided between the lightening portion and the internal opening of the casing portion, and the lightening portion and the internal opening are coupled to each other.

7. The axial fan according to claim 1, wherein the housing has a polygonal shape including a plurality of corner portions in a plan view perpendicular to an air-blowing direction of the axial fan, and the level difference portion and the lightening portion are provided near each corner of the plurality of the corner portions.

8. The axial fan according to claim 7, wherein the level difference portion is provided between the lightening portion and the internal opening of the casing portion, and the lightening portion and the internal opening are coupled to each other.

9. An axial fan comprising:

an impeller cup including a blade extending in a radial direction;

a motor configured to rotate the impeller cup; and a housing accommodating the impeller cup and the motor, wherein the housing includes:

a casing portion covering an outer periphery of the impeller cup;

a base portion supporting the motor; and a spoke portion connecting the base portion and the casing portion, the casing portion includes an inlet surface where air is drawn in, and an outlet surface where the air is discharged, a rectangular lightening portion is open partially in the outlet surface of the casing portion, the rectangular lightening portion has a rectangular shape in a plan view perpendicular to the outlet surface, the rectangular lightening portion has a first width in the radial direction and a second width in a circumferential direction of the axial fan, the second width is smaller than the first width, a position on the outlet surface of the casing portion where a radially outer end of the spoke portion is connected is set in such a manner as to be different from a position on the casing portion where the lightening portion is formed, wherein the casing portion is provided with a level difference portion at least partially in an inner peripheral surface of the casing portion on a side of the outlet surface, the level difference portion is provided between the lightening portion and an airway of the axial fan, and the lightening portion is communicated with the airway, via the level difference portion.

10. The axial fan according to claim 9, wherein the level difference portion has a third width in the circumferential direction, the third width being identical to the second width of the rectangular lightening portion.

11. The axial fan according to claim 9, wherein the casing portion includes the airway which is an internal opening of the casing portion, the level difference portion is provided between the lightening portion and the internal opening of the casing portion, and the lightening portion and the internal opening are coupled to each other.

12. The axial fan according to claim 9, wherein the housing has a polygonal shape including a plurality of corner portions in a plan view perpendicular to an air-blowing direction of the axial fan, and the level difference portion and the lightening portion are provided near each corner of the plurality of the corner portions.

13. The axial fan according to claim 12, wherein the casing portion includes the airway which is an internal opening of the casing portion, the level difference portion is provided between the lightening portion and the internal opening of the casing portion, and the lightening portion and the internal opening are coupled to each other.

* * * * *